US006662597B2

(12) United States Patent
Vanasse

(10) Patent No.: US 6,662,597 B2
(45) Date of Patent: Dec. 16, 2003

(54) APPARATUS AND METHOD FOR CONNECTING TOGETHER AND PROTECTING FIRST AND SECOND ENDS OF AN ARTICLE OF JEWELRY

(76) Inventor: Sheryl A. Vanasse, N7841 290th St., Spring Valley, WI (US) 54767

( * ) Notice: Subject to any disclaimer, the term of this patent is extended or adjusted under 35 U.S.C. 154(b) by 0 days.

(21) Appl. No.: 09/875,316

(22) Filed: Jun. 6, 2001

(65) Prior Publication Data

US 2002/0184914 A1 Dec. 12, 2002

(51) Int. Cl.[7] ..... A44C 5/00

(52) U.S. Cl. ..... 63/3.1; 63/3; 24/574.1; 24/633

(58) Field of Search ..... 63/3, 3.1; 24/574.1, 24/633

(56) References Cited

U.S. PATENT DOCUMENTS

| | | | | |
|---|---|---|---|---|
| 1,578,940 A | | 3/1926 | Wacha | |
| 1,771,427 A | * | 7/1930 | Waterhouse | 24/600.4 |
| 2,623,256 A | | 12/1952 | Feibelman | |
| 3,543,356 A | * | 12/1970 | Zimmermann | 24/574.1 |
| 3,974,545 A | | 8/1976 | Lossini | |
| 3,988,813 A | | 11/1976 | Korcey, Jr. | |
| 4,377,078 A | * | 3/1983 | Block | 63/3.1 |
| 4,590,649 A | * | 5/1986 | Neilson, Jr. | 24/616 |
| D284,176 S | | 6/1986 | Battersby | |
| 4,611,368 A | | 9/1986 | Battersby | |
| 4,665,595 A | * | 5/1987 | Viot et al. | 24/616 |
| 4,697,436 A | | 10/1987 | Schmidt | |
| 4,961,251 A | * | 10/1990 | Smith | 24/633 |
| 5,214,940 A | | 6/1993 | Capifali | |
| 5,440,900 A | | 8/1995 | White | |
| 5,457,852 A | | 10/1995 | Liu | |
| 5,687,585 A | | 11/1997 | Ferrell | |
| 5,722,260 A | | 3/1998 | Mangano | |

FOREIGN PATENT DOCUMENTS

| | | |
|---|---|---|
| DE | 958783 | 2/1957 |
| DE | 19615146 | 10/1997 |
| DE | 19702981 | 7/1998 |
| FR | 1000098 | 2/1952 |

* cited by examiner

*Primary Examiner*—Andrea Chop
(74) *Attorney, Agent, or Firm*—Michael A. Mochinski

(57) ABSTRACT

An apparatus for use in connecting and protecting first and second ends of an article of jewelry, wherein the apparatus comprises a cylindrical body having a longitudinal bore extending therethrough for passage of a clasp comprised of a loop and a ring member having a latching mechanism slidably fitted thereto to engage a portion of the loop. The cylindrical body is fitted to and tighteningly stretched over and about the clasp to prevent unintentional twisting of the two ends within and about the clasp insofar to alleviate the occurrence of breakage thereat and to prevent entanglement of the clasp with the wearer's hair. The cylindrical body is generally made from a pliable, translucent material to retain the overall aesthetic qualities and appearance of the article of jewelry as it is positioned over and about the clasp.

24 Claims, 3 Drawing Sheets

APPARATUS AND METHOD FOR CONNECTING TOGETHER AND PROTECTING FIRST AND SECOND ENDS OF AN ARTICLE OF JEWELRY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to an apparatus and method for connecting together and protecting ends of an article of jewelry. More particularly, the present invention relates to an improved apparatus for connecting together the ends of the article of jewelry with a clasp comprising protective means to prevent unwanted entanglement with the wearer's hair, inhibit inadvertent release of the ends of the article of jewelry from the clasp during use thereof, and minimize the article of jewelry's tendency to rotate about the wearer's neck or wrist.

BACKGROUND OF THE INVENTION

It is generally understood that many forms of decorative jewelry include means to securely attach the ends thereof during placement of such about the wearer's neck or wrist. It is also well known that the means of attaching the ends of the piece of jewelry come in a variety of shapes and forms. Most articles of jewelry are equipped with a clasping mechanism generally comprised of an open-ended, tubular ring member having a sliding gate fitted therein to serve as means to open a portion of the ring member for subsequent engagement with a loop that is generally attached to the other end of the decorative chain or strand. While in other instances, the clasp may take on the form of a longitudinal, tubular sleeve or receptacle that is geometrically designed to accept and lock in place the other end of the decorative chain. However, in principle, most articles of jewelry will have some form of attachment means that may inadvertently disengage during use thereof or be prone to becoming entangled with the wearer's hair.

Although the relevant body of the art discloses devices for use with an article of jewelry, most are directed to adding decorative features to and concealing the clasp from observers or provide in and of itself the means to attach the ends of the decorative chain or strand. For instance, U.S. Pat. No. 5,214,940 shows a dress cap that substantially fits over the clasping device to add or enhance the aesthetic features of an article of jewelry. Similarly, U.S. Pat. No. 5,722,260 discloses a clam-like enclosure that includes receiving hooks to engage the ends of the chain. In most instances, particularly with the foregoing, the jewelry ends may require retrofitting to accommodate such decorative devices or may be unattractive due to their bulky appearance.

Accordingly, there remains a need for a device which is inexpensive to manufacture and affordable to the average consumer, adequately secures the ends of an article of jewelry with a clasp having protective means to prevent entanglement thereof with the wearer's hair, adaptably secures the article of jewelry to the wearer to prevent the occurrence of rotational movement thereof about the wearer's neckline or wrist, and retains the aesthetic qualities and decorative features of the article of jewelry.

BRIEF SUMMARY OF THE INVENTION

In order to overcome the numerous drawbacks apparent in the prior art, an improved apparatus has been devised for use in connecting together and protecting first and second ends of an article of jewelry.

It is thus an object of the present invention to provide a low cost non-complicated apparatus which may be reliably and securely attached to the article of jewelry so that it may be readily and easily usable.

It is another object of the present invention to provide such an apparatus which reliably secures the clasp in place during use thereof.

It is another object of the present invention to provide such an apparatus which retains the aesthetic qualities and decorative features of the article of jewelry.

It is another object of the present invention to provide such an apparatus which prevents or inhibits the inadvertent disengagement of the clasp.

It is another object of the present invention to provide such an apparatus which inhibits entanglement of the clasp with the wearer's hair as well as other obstructions.

It is another object of the present invention to provide such an apparatus which minimizes the article of jewelry's tendency to rotate about the wearer's neck.

It is another object of the present invention to provide such an apparatus which does not sacrifice comfort to the wearer during use thereof.

It is another object of the present invention to provide such an apparatus which can be adapted for use on a variety of fashionable articles of jewelry without undue modification thereto.

It is another object of the present invention to provide such an apparatus which is easily mounted on and detached from the article of jewelry.

It is yet another object of the present invention to provide such an apparatus which accomplishes the foregoing and other objects and advantages and which is economical, durable, and fully effective in performing its intended functions.

In accordance with the present invention, an apparatus has been devised for use with an article of jewelry having first and second ends interconnected by a continuous chain or strand, wherein the first end is fixedly connected to a ring member while a second end is fixedly attached to a loop. The apparatus preferably comprises a cylindrical body having a longitudinal bore extending therethrough for passage of a clasp comprised of the ring member and loop. The length of the cylindrical body is preferably equivalent to the length of the clasp used to interconnect the decorative chain ends, while the diameter thereof is slightly less than the effective outer diameter of the clasp. In operation, the cylindrical body is adaptably fitted to and tighteningly stretched over the loop and is slidably positioned toward the second end until a portion of the loop is left exposed to permit engagement with the ring member. A handle made part of the latching mechanism and extending outwardly therefrom is slidably retracted along the periphery of the ring member to open a portion thereof to accept and receive that portion of the loop left exposed. The latching mechanism is then selectively closed by releasing the handle, with the cylindrical body being slidably moved inward toward the first end and longitudinally over the ring member and loop until each is adequately covered thereby.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiment illustrated. The present invention has particular utility as a device for protecting articles of jewelry having a clasp for attaching the ends of a decorative chain or strand and will be described as such although the present invention may be used equally well for protecting other aspects of articles of jewelry having a variety of shapes and configurations.

Figure 1:
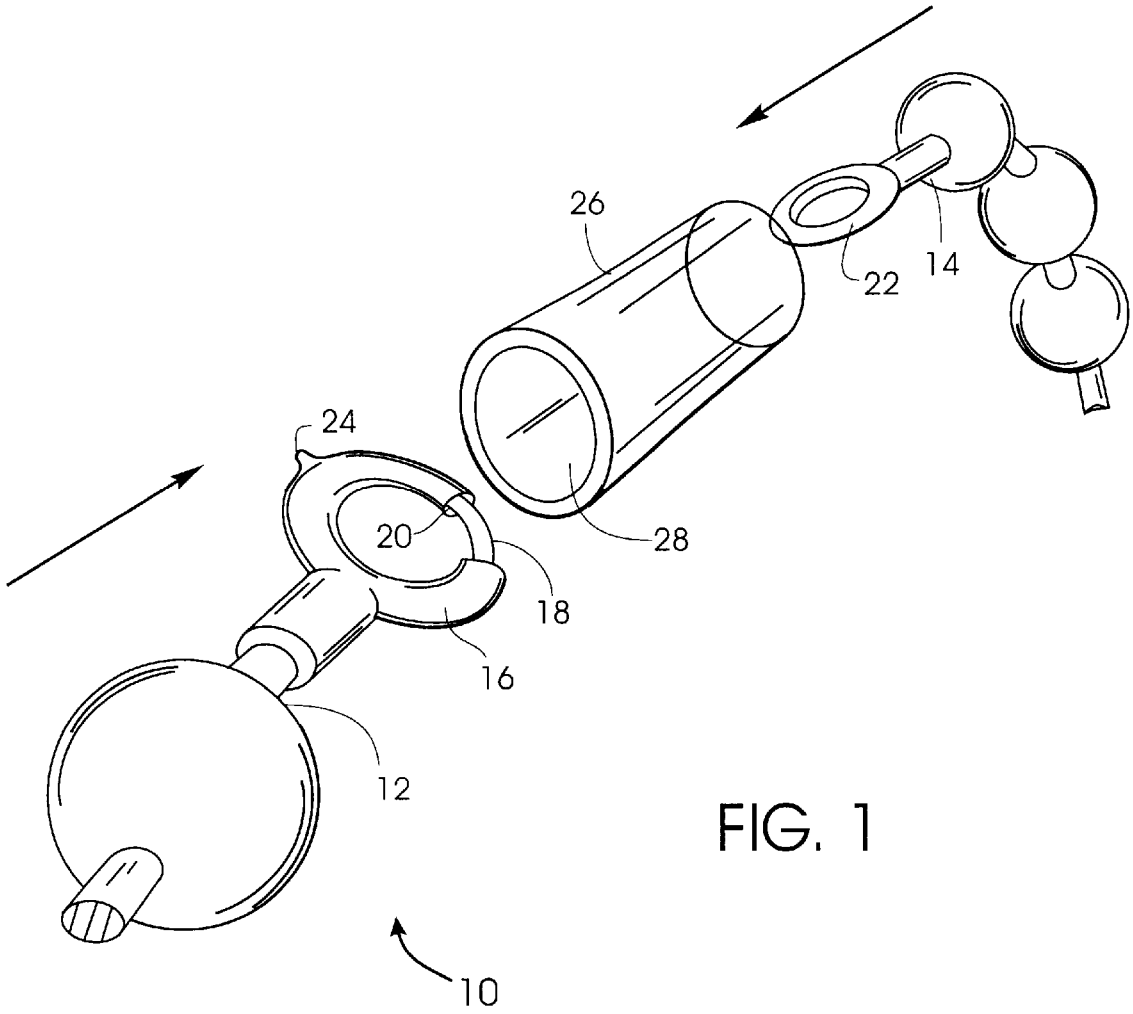
FIG. 1 is a perspective view of the preferred embodiment of the present invention illustrating the positioning thereof relative to the ends of the jewelry chain before being fitted thereon.

Referring to FIG. 1, there is shown generally at 10 an article of jewelry having first 12 and second 14 ends each being connectively fastened to one another by a clasp. Preferably the clasp comprises a ring member 16 fixedly attached to the first end, wherein the ring member comprises a spring loaded latching mechanism 18 adaptably configured to fit and slidably move within a bore 20 that extends through the ring member. The latching mechanism selectively serves to open and close a portion of the ring member to permit engagement with a loop 22 fixedly attached to the second end 14 of the chain. Opening of the latching mechanism is accomplished by pulling back on a handle 24 that is fixedly connected to the latching mechanism 18 and protrudes radially outward therefrom and the ring member 16.

Figure 2:
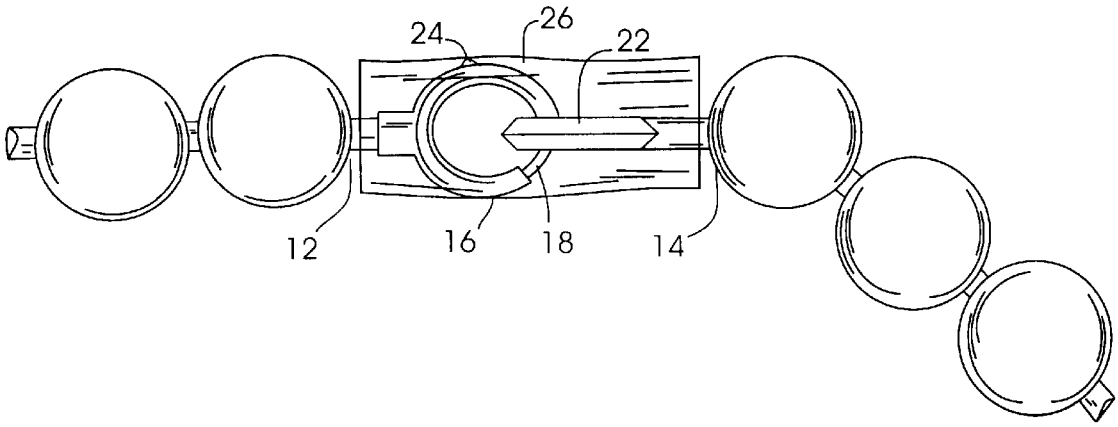
FIG. 2 is a perspective view of the preferred embodiment of the present invention illustrating the final, desired positioning thereof over the jewelry's clasp.

The preferred embodiment of the present invention comprises a cylindrical body 26 having a longitudinal bore 28 extending therethrough for passage of the ends of the chain 12, 14 and the ring member 16 and loop 22 comprising the clasp. The length of the cylindrical body is generally sized to partially extend beyond the area defined by the clasp as it is finally positioned thereover, as depicted in FIG. 2. In the preferred embodiment, the cylindrical body 26 generally comprises a length equivalent to the length of most jewelry clasps of approximately ¾-1". The cylindrical body can be constructed from a variety of materials, but is preferably made from polyvinyl chloride (PVC) or a similar material having the capacity of being stretched and fitted over the clasp without permanent deformation. Further, constructing the cylindrical body from PVC substantially inhibits rotational movement of the article of jewelry about the wearer's neck due to the slight cohesiveness of PVC as it is applied to a person's skin. It is preferred that the longitudinal bore includes a diameter of ⅛ of an inch less than the diameter of the ring member so as to fit tightly thereabout to inhibit unwanted rotational motion of the clasp about the chain ends and prevent breakage thereat. In fact, field testing of the present invention revealed that clasp diameters smaller than the longitudinal bore inadequately secured the clasp in place and moved about the clasp and chain ends, thereby failing to achieve the desired objectives.

Figure 3:
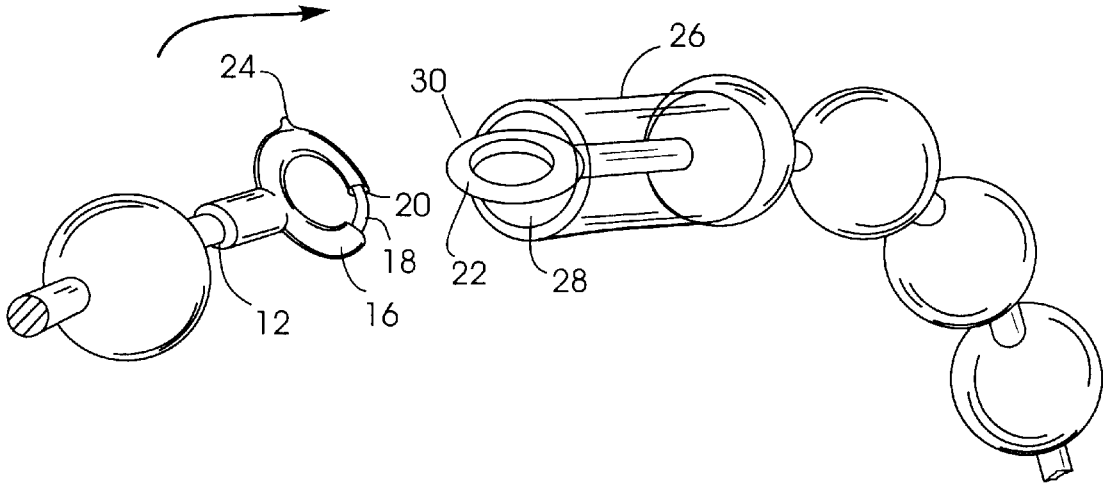
FIG. 3 is a perspective view of the preferred embodiment of the present invention illustrating the positioning thereof over one of the ends of the jewelry chain.

In operation, the wearer initially opens the clasp by pulling back on the handle 24 for radial movement of the spring loaded latching mechanism 18 about the ring member 16. This action causes a portion of the ring member to open for release of the loop from the ring member. The cylindrical body 26 is then fitted and positioned over the loop 22 until a portion 30 thereof is left exposed, as depicted in FIG. 3. In some instances, the decorative features of the article of jewelry may inhibit longitudinal travel of the cylindrical body about the loop. In which case, a cylindrical body of shorter length will be required in order to have a portion of the loop be left exposed for adequate engagement of the latching member 18 thereto. The ring member, with the latching member in a retracted position, is positioned near and aligned with the exposed portion of the loop to permit full engagement of the latching mechanism with the loop as the handle 24 is released by the wearer. The cylindrical body 26 is then stretched and repositioned longitudinally over the ring member 16 and loop 22 until an equal portion thereof exists on each side of the components comprising the clasp, as shown in FIG. 2. In some instances, because of the tendency of the clasp and cylindrical body to stick or adhere to one another during positioning thereof, the wearer may be required to rotate or twist the cylindrical body about the longitudinal axis in order to achieve the desired positioning of the cylindrical body 26 about the clasp. However, once the present invention is in this desired position, the clasp is fully protected and prevented from entangling with the wearer's hair, adequately secures the clasp to mitigate inadvertent disengagement of the chain ends from the components comprising the clasp, and inhibits rotational motion or travel of the article of jewelry about the wearer's neckline.

To disengage the present invention from the article of jewelry, the wearer simply reverses the above process. With a firm grip on the ring member 16 attached to the first end 12, the cylindrical body 26 is longitudinally pulled over and beyond the second chain end 14 to a position that exposes a portion 30 of the loop 22, as seen in FIG. 3. The handle 24 is then pulled back to release the latching member 18 from the loop. To simplify use of the present invention during the next application of the article of jewelry on the wearer, the cylindrical body 26 can be left attached to the second chain end 14 during storage thereof.

It is obvious that the device hereinbefore described can be used with various sizes of clasps by simply exchanging the size of the cylindrical body 26.

It can be seen from the foregoing that there is provided in accordance with this invention a simple and easily operated device, which is particularly suitable for use on articles of jewelry having ends that are temporarily joined by the clasp. The device is inexpensive to manufacture and can be sold at a nominal price. Furthermore, the device is readily adaptable for use with a variety of articles of jewelry without having to modify or add structural features to the ends of the decorative chain and clasp.

It is obvious that the device may be fabricated from a variety of materials having pliable, flexible characteristics. It is most desirable, and therefore preferred, to use materials having translucent qualities to retain the overall aesthetic features and appearance of those component generally comprising the article of jewelry.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. An apparatus for use in connecting together and protecting first and second ends of an article of jewelry, said apparatus comprising in combination:

a clasp having a ring member and a loop each being fixedly attached to the first and second ends, respectively, said ring member having means for engaging said loop; and a unitary, one-piece cylindrical body having a constant diameter throughout its entire length and a longitudinal bore extending therethrough to permit passage and house said ring member and said loop while each is connectively fastened to one another, said cylindrical body having a length extending the entire length of said clasp and completely enclosing said clasp while each is connectively fastened to one another.

2. An apparatus as defined in claim 1, wherein said engaging means comprises a bore extending through said ring member to permit passage and slidable movement of a spring loaded latching mechanism having attached thereto a handle to selectively open and close a portion of said ring member.

3. An apparatus as defined in claim 1, wherein said longitudinal bore comprises a diameter at least ⅛ of an inch less than the diameter of said clasp so as to adaptably stretch thereover and tighteningly secure together said ring member and said loop insofar to prevent unintentional twisting and longitudinal rotation of said clasp about the first and second ends of the article of jewelry.

4. An apparatus as defined in claim 1, wherein said cylindrical body is at least ¾ of inch in length and fabricated from a material having translucent qualities so as to retain the overall decorative features and aesthetics qualities of the article of jewelry.

5. An apparatus as defined in claim 1, wherein said cylindrical body is fabricated from a flexible, pliable material capable of withstanding permanent deformation after continued and sustained use.

6. An apparatus as defined in claim 5, wherein the flexible, pliable material is polyvinyl chloride.

7. A method of connecting together and protecting first and second ends of an article of jewelry, said method comprising the steps of:

supplying a clasp having a ring member and a loop each being fixedly attached to the first and second ends, respectively, said ring member having a bore extending therethrough to permit passage and slidable movement of a spring loaded latching mechanism having attached thereto a handle to selectively open and close a portion of said ring member;

placing a unitary, one-piece cylindrical body having a constant diameter throughout its entire length onto and over said loop and inwardly sliding said cylindrical body toward the second end until a portion of said loop is left exposed;

connecting said ring member to said loop by slidably moving said handle along the outer periphery of said ring member to open a portion thereof for receiving and engaging the portion of said loop left exposed and releasing said handle to close said latching mechanism insofar to lock and secure said loop to said ring member; and sliding said cylindrical body toward the first end and longitudinally over said ring member and said loop until each is completely enclosed and covered thereby.

8. A method as defined in claim 7, wherein said cylindrical body comprises a longitudinal bore having a diameter at least ⅛ of an inch less than the effective outer diameter of said clasp so as to adaptably stretch thereover and tighteningly secure together said ring member and said loop insofar to prevent unintentional twisting and longitudinal rotation of each about the first and second ends of the article of jewelry.

9. A method as defined in claim 7, wherein said cylindrical body is at least ¾ of inch in length.

10. A method as defined in claim 7, wherein said cylindrical body is fabricated from a flexible, pliable material having the capacity to withstand permanent deformation after continued and sustained use.

11. A method as defined in claim 10, wherein the flexible, pliable material is polyvinyl chloride.

12. A method as defined in claim 7, wherein said cylindrical body comprises a smooth exterior surface to provide added comfort to a wearer.

13. A method as defined in claim 7, wherein said cylindrical body is fabricated from a material having translucent qualities so as to retain the overall aesthetics characteristics and decorative features of the article of jewelry.

14. A method as defined in claim 7, wherein the step of sliding said cylindrical body over said ring member and said loop includes twistably rotating said cylindrical body about the longitudinal axis thereof to commence and ease the positioning of said cylindrical body over said ring member and said loop.

15. A method as defined in claim 7, further comprising the step of positioning said cylindrical body onto a wearer's neck surface to allow said cylindrical body to adhere thereto to prevent unintentional, rotational movement of the article of jewelry about the wearer's neckline.

16. A method of connecting together and protecting first and second ends of an article of jewelry, said method comprising the steps of:

providing a clasp having a ring member and a loop each being fixedly attached to the first and second ends, respectively, said ring member having a bore extending therethrough to permit passage and slidable movement of a spring loaded latching mechanism having attached thereto a handle to selectively open and close a portion of said ring member;

fitting onto said loop a unitary, one-piece cylindrical body having a constant diameter throughout its entire length and being made from a material having translucent qualities so as to retain the overall aesthetics characteristics of the article of jewelry;

moving said cylindrical body inwardly toward the second end and longitudinally over said loop until a portion thereof is left exposed;

connecting said ring member to said loop by slidably moving said handle along the outer periphery of said ring member to open a portion thereof for receiving and engaging the portion of said loop left exposed and releasing said handle to close said latching mechanism insofar to lock and secure said loop to said ring member;

twistably rotating said cylindrical body about the longitudinal axis thereof to commence and ease the positioning of said cylindrical body over said clasp; and continuing the action of rotating while slidably positioning said cylindrical body over said ring member and said loop until both are adequately covered thereby.

17. A method as defined in claim 16, wherein said cylindrical body comprises a length substantially equivalent to the length of said clasp comprised of said ring member and said loop while each is connectively fastened to one another.

18. A method as defined in claim 16, wherein said cylindrical body is fabricated from a flexible, pliable material capable of withstanding permanent deformation after continued and sustained use.

19. A method as defined in claim 16, wherein said cylindrical body comprises a longitudinal bore having a diameter at least ⅛ of an inch less than the effective outer diameter of said clasp so as to adaptably stretch thereover and tighteningly secure together said ring member and said loop insofar to prevent unintentional twisting and longitudinal rotation of each about the first and second ends of the article of jewelry.

20. A method of connecting together and protecting first and second ends of an article of jewelry, said method comprising the steps of:

providing a clasp having a ring member and a loop each being fixedly attached to the first and second ends, respectively, said ring member having a bore extending therethrough to permit passage and slidable movement of a spring loaded latching mechanism having attached thereto a handle to selectively open and close a portion of said ring member;

fitting onto said loop a unitary, one-piece cylindrical body made from a flexible, pliable material capable of withstanding permanent deformation after continued and sustained use and having translucent qualities so as to retain the overall aesthetics characteristics of the article of jewelry;

moving said cylindrical body inwardly toward the second end and longitudinally over said loop until a portion thereof is left exposed;

connecting said ring member to said loop by slidably moving said handle along the outer periphery of said ring member to open a portion thereof for receiving and engaging the portion of said loop left exposed and releasing said handle to close said latching mechanism insofar to lock and secure said loop to said ring member;

twistably rotating said cylindrical body about the longitudinal axis thereof to commence and ease the positioning of said cylindrical body over said clasp; and continuing the action of rotating while slidably positioning said cylindrical body over said ring member and said loop until both are adequately covered thereby.

21. An apparatus for use in connecting together and protecting first and second ends of an article of jewelry, said apparatus comprising in combination:

a clasp having a ring member and a loop each being fixedly attached to the first and second ends, respectively, said ring member having means for engaging said loop; and a unitary, one-piece cylindrical body having a longitudinal bore extending therethrough to permit passage and house said ring member and said loop while each is connectively fastened to one another, said cylindrical body having a length of at least ¾ of inch to completely enclose said clasp while each is connectively fastened to one another and being fabricated from a material having translucent qualities so as to retain the overall decorative features and aesthetics qualities of the article of jewelry.

22. An apparatus for use in connecting together and protecting first and second ends of an article of jewelry, said apparatus comprising in combination:

a clasp having a ring member and a loop each being fixedly attached to the first and second ends, respectively, said ring member having means for engaging said loop; and a unitary, one-piece cylindrical body having a longitudinal bore extending therethrough to permit passage and house said ring member and said loop while each is connectively fastened to one another, said cylindrical body having a length extending the entire length of said clasp and completely enclosing said clasp while each is connectively fastened to one another and being fabricated from a flexible, pliable material capable of withstanding permanent deformation after continued and sustained use.

23. A method of connecting together and protecting first and second ends of an article of jewelry, said method comprising the steps of:

supplying a clasp having a ring member and a loop each being fixedly attached to the first and second ends, respectively, said ring member having a bore extending therethrough to permit passage and slidable movement of a spring loaded latching mechanism having attached thereto a handle to selectively open and close a portion of said ring member;

placing a unitary, one-piece cylindrical body onto and over said loop and inwardly sliding said cylindrical body toward the second end until a portion of said loop is left exposed, said cylindrical body being fabricated from a flexible, pliable material having the capacity to withstand permanent deformation after continued and sustained use;

connecting said ring member to said loop by slidably moving said handle along the outer periphery of said ring member to open a portion thereof for receiving and engaging the portion of said loop left exposed and releasing said handle to close said latching mechanism insofar to lock and secure said loop to said ring member; and sliding said cylindrical body toward the first end and longitudinally over said ring member and said loop until each is completely enclosed and covered thereby.

24. A method of connecting together and protecting first and second ends of an article of jewelry, said method comprising the steps of:

supplying a clasp having a ring member and a loop each being fixedly attached to the first and second ends, respectively, said ring member having a bore extending therethrough to permit passage and slidable movement of a spring loaded latching mechanism having attached thereto a handle to selectively open and close a portion of said ring member;

placing a unitary, one-piece cylindrical body onto and over said loop and inwardly sliding said cylindrical body toward the second end until a portion of said loop is left exposed, said cylindrical body being fabricated from a material having translucent qualities so as to retain the overall aesthetics characteristics and decorative features of the article of jewelry;

connecting said ring member to said loop by slidably moving said handle along the outer periphery of said ring member to open a portion thereof for receiving and engaging the portion of said loop left exposed and releasing said handle to close said latching mechanism insofar to lock and secure said loop to said ring member; and sliding said cylindrical body toward the first end and longitudinally over said ring member and said loop until each is completely enclosed and covered thereby.

* * * * *